US005240743A

United States Patent [19]

Tuller et al.

[11] Patent Number: 5,240,743

[45] Date of Patent: Aug. 31, 1993

[54] FIBER FINISHING METHODS

[75] Inventors: F. Norman Tuller, Simpsonville; Michael E. Allen, Greenville, both of S.C.

[73] Assignee: Henkel Corporation, Ambler, Pa.

[21] Appl. No.: 843,135

[22] Filed: Feb. 28, 1992

[51] Int. Cl.[5] ..... B05D 5/00

[52] U.S. Cl. ..... 427/384; 252/8.6; 252/8.9

[58] Field of Search ..... 252/8.6, 8.9

[56] References Cited

U.S. PATENT DOCUMENTS

| | | | |
|---|---|---|---|
| 2,109,947 | 3/1938 | North | 260/103 |
| 2,803,646 | 8/1957 | Bell et al. | 260/484 |
| 3,342,858 | 9/1987 | Fuhrmann | 260/531 |
| 3,518,184 | 6/1970 | Potter | 252/8.9 |
| 3,522,175 | 7/1970 | Katsumi et al. | 252/8.8 |
| 3,575,856 | 4/1971 | Anton | 252/8.9 |
| 3,677,725 | 7/1972 | Andress | 252/8.6 |
| 3,853,607 | 12/1974 | Iyengar et al. | 252/8.6 |
| 3,896,032 | 7/1975 | Stroh et al. | 252/8.6 |
| 3,907,689 | 9/1975 | Carver | 252/8.7 |
| 3,926,816 | 12/1975 | Cohen et al. | 252/8.9 |
| 3,951,825 | 4/1976 | Carver | 252/8.7 |
| 3,970,569 | 7/1976 | Sturwold et al. | 252/49.3 |
| 4,098,702 | 4/1978 | Crossfield et al. | 252/8.6 |
| 4,163,114 | 7/1979 | Koleske et al. | 560/186 |
| 4,403,049 | 9/1983 | Murase et al. | 523/455 |
| 4,464,182 | 8/1984 | Tack et al. | 44/62 |
| 4,505,956 | 3/1985 | Yamamoto et al. | 427/393.1 |
| 4,615,816 | 10/1986 | Ogiso et al. | 252/8.9 |
| 4,766,153 | 8/1988 | Casciani | 514/785 |

FOREIGN PATENT DOCUMENTS

| | | |
|---|---|---|
| 0359087 | 3/1990 | European Pat. Off. . |
| 52-55794 | 7/1977 | Japan . |

*Primary Examiner*—Anthony McFarlane

*Attorney, Agent, or Firm*—Wayne C. Jaeschke; Frank S. Chow; Ashley I. Pezzner

[57] ABSTRACT

This invention is directed to a method for treating fibers by applying thereto a compound having the general formula $$R_1-O-(X)_n-CH_2-\overset{\overset{\displaystyle O}{\|}}{C}-O-R_2 \qquad (I)$$

wherein $R_1$ is alkyl from 1 to 23 carbon atoms, $R_2$ is alkyl from 1 to 23 carbon atoms, n is a number from 3 to 15, and X is $-C_2H_4O-$ or $-C_3H_6O-$, or a mixture of $-C_2H_4O-$ and $-C_3H_6O-$.

13 Claims, No Drawings

FIBER FINISHING METHODS

BACKGROUND OF THE INVENTION

1. Field of the Invention

This invention relates to novel methods for fiber finishing. In particular, the present invention relates to methods of imparting lubricity to fibers.

2. Description of the Related Art

Generally, in the case of many fiber materials, finishing compositions are applied to fibers to improve their subsequent handling and processing. Fiber finishes, in part, enable a fiber producer to manufacture a fiber product and in turn enable a purchaser of that product to utilize yarn and fabric manufacturing processes to obtain an end product. The composition and amount of a particular fiber finish applied depend in large measure upon the chemical characteristics of a particular fiber, the particular stage in the processing of the fiber at which it is applied, and the envisioned use of the particular fiber.

Such finishes generally provide lubrication, prevent static build-up, and afford a slight cohesion between adjacent fibers. Many other characteristics, however, are also desirable. For example, they should be easily applied to and removed from fibers and should be useful in subsequent treatment of the fibers. Also, they should have desirable thermal and chemical stability while not adversely affecting the fibers themselves. Such fiber finishes should not leave residues on objects they come in contact with nor cause toxic fumes or undesirable odors. They should provide for rapid wetting of fiber surfaces, be water-soluble or emulsifiable or solvent-soluble, and have good storage stability. Further, they should not attract soil, cause color changes to fibers, interact with frictional elements used in texturizing or be corrosive to machine parts.

Application of such finishes may generally be accomplished by contacting a fiber tow or yarn with a solution or emulsion comprising at least one lubricant having desirable antistatic properties. Additional antistatic agents, wetting agents, additives such as antioxidants, biocides, anti-corrosion agents, pH control agents, as well as emulsifiers are also commonly found in such finishes. A suitable fiber finish may also be sprayed or applied directly onto fibers or yarn.

In the past, fiber finishes were composed of many elements in addition to a lubricant with each element imparting a desirable characteristic to the fiber finish. For example, in addition to the lubricant, antistatic agents were often added to increase the ability of the fiber to avoid buildup of static electric charge. Also emulsifiers were often added to aid in the application to the fiber of the often oily and unmanageable lubricant.

Various lubricating agents have been disclosed by Ogiso et al. U.S. Pat. No. 4,615,816, Yamamoto et al. U.S. Pat. No. 4,505,956, Carver U.S. Pat. No. 3,951,825, Carver U.S. Pat. No. 3,907,689, Koleske U.S. Pat. No. 4,163,114, and Sturwold et al. U.S. Pat. No. 3,970,569. Various fiber finishes have been disclosed by Crossfield et al. U.S. Pat. No. 4,098,702 and Murase et al. U.S. Pat. No. 4,403,049. Casciani U.S. Pat. No. 4,766,153 discloses certain alkyl polyoxy alkylene carboxylates which are surface active agents and stated that they are suitable as emulsifiers, dispersing agents, lubricants, wetting agents, levelling agents, and the like in the textile industry, e.g. as wetting, softening or lubricating agents. In addition, ether carboxylate esters have also been employed as plasticizers. See Bell et al. U.S. Pat. No. 2,803,646 and North U.S. Pat. No. 2,109,947.

While these efforts may be satisfactory, they all involve the use of emulsifiers and sometimes they are difficult to handle due to the viscosity of some compounds. Accordingly, a more desirable method is indicated which can impart desirable properties, e.g. lubricity, in fiber finishes. Such a method should be able to be applied to a fiber with little or without the use of emulsifiers while imparting desirable characteristics, e.g. lubricity.

BRIEF SUMMARY OF THE INVENTION

According to the present invention, the desired fiber finishing, e.g. lubricity, is achieved by applying an effective lubricating amount of a compound selected from those having the general formula $$R_1-O-(X)_n-CH_2-\overset{\overset{\displaystyle O}{\|}}{C}-O-R_2 \qquad (I)$$

wherein $R_1$ is cyclic, straight, or branched chain alkyl, saturated or unsaturated, from 1 to 23 carbon atoms, n is a number from 3 to 15, X is $-C_2H_4O-$, or $-C_3H_6O-$, or a mixture of $-C_2H_4O-$ and $-C_3H_6O-$, and R2 is cyclic, straight, or branched chain alkyl, saturated or unsaturated, from 1 to 23 carbon atoms. As examples of alkyl, there may be mentioned methyl, ethyl, propyl, butyl, pentyl, hexyl, septyl, octyl, nonyl, decyl, dodecyl, tetradecyl, hexadecyl, octadecyl, iso-octadecyl, stearyl, oleyl and the like.

The compounds useful in the present invention comprise a narrow class of ether carboxylate ester compounds, which when applied to the fiber in a manner described below, exhibit desirable viscosity, lubricity, and ease of handling resulting in a diminished need to employ various other components in combination therewith to be utilized as a fiber finish. These and other features and advantages of the present invention may be more clearly understood by considering the following description of specific embodiments.

DESCRIPTION OF SPECIFIC EMBODIMENTS

According to the present invention, there is provided a method of fiber finishing and more particularly there is provided a method of imparting lubricity to fibers by applying thereto an effective amount of a compound having the general formula $$R_1-O-(X)_n-CH_2-\overset{\overset{\displaystyle O}{\|}}{C}-O-R_2 \qquad (I)$$

wherein $R_1$ or $R_2$ is cyclic, straight, or branched chain alkyl, saturated or unsaturated, from 1 to 23 carbon atoms. $R_1$ and $R_2$ may each preferably have from 6 to 20 carbon atoms, 16 to 18 carbon atoms, 12 to 14 carbon atoms, 8 to 10 carbon atoms or 1 to 5 carbon atoms. In addition to having a single value, for example $R_1$ or $R_2$ being alkyl of 1, 8, 9, 10, 16, 17, or 18 carbon atoms, either $R_1$ or $R_2$ may exist as a ratio of a number of carbon atoms within the above ranges. For example, for the given range of 16 to 18 carbon atoms, $R_1$ may exist as a ratio of $C_{16}$, $C_{17}$ and $C_{18}$. It is to be understood that $R_1$ and $R_2$ may have different values and do not necessarily have to be represented by the same range of carbon atoms. For example in a preferred embodiment, $R_1$ may be a ratio of $C_{16}$, $C_{17}$, and $C_{18}$, while $R_2$ may be Cl or methyl. The number of repeating X units is represented by n being a number from 3 to 15, preferably 3 to 5, and most preferably 5, and X is $—C_2H_4O—$, or $—C_3H_6O—$, or a mixture of $—C_2H_4O—$ and $—C_3H_6O—$.

Compounds of formula I may be generally prepared by reacting an alcohol having a carbon chain of desired length, for example, any of the ranges previously mentioned, with an alkylene oxide such as ethylene oxide or propylene oxide, to form an alkoxylated alcohol. Synthesis may also begin with a previously synthesized alkoxylated alcohol. The alkoxylated alcohol is then reacted with a strong base, for example, a potassium or sodium base in the presence of a reducing agent such as sodium borohydride to form the corresponding potassium or sodium alkoxylate. This product then reacts with sodium chloroacetate to form an ether carboxylic acid salt. This salt is then converted to the corresponding acid by washing with aqueous sulfuric acid. The ether carboxylic acid is then esterified by reaction with a desired alcohol having a carbon chain of desired length, for example, any of the ranges previously mentioned, to produce the compounds of the present invention.

In fiber finishing, these compounds may be applied alone or optionally by combining them with suitable antistatic agents and emulsifiers, if necessary, as well as other desirable fiber finish components. Fibers may be coated with an effective amount of the compounds of the present invention either alone or with other components of a fiber finish by towing a fiber strand through the compound or fiber finish or by directly spraying the compound or fiber finish onto the fiber. It should be understood that the compounds of the present invention exhibit suitable viscosity, lubricity and emulsifiability to enable their use alone or without certain of the above components in a fiber finish.

The following examples set forth certain specific embodiments of the invention and are provided to enable those of skill in the art to produce the compounds useful in the practice the invention and to illustrate the utility of the invention in certain applications. These examples should not be construed to limit the scope of the invention, which is limited only by the lawful scope of the appended claims.

EXAMPLE I

Preparation of Octyl Carbomethoxymethyl PEG 220 Ether

(a) Preparation of octyl carboxymethyl PEG 220 ether

To a reaction vessel was added, with stirring, 10500 g (30 moles) of the 5 mole ethoxylate of octyl alcohol (alkyl chain 95% minimum C8, hydroxyl number 160 mg KOH/g). The reaction vessel was sealed and degassed four times at approximately 25°-40° C. by alternately pulling 30 inches of vacuum and purging with dry nitrogen. The moisture content of the reaction vessel was checked with a preferred percentage of moisture being less than 0.01% of the reaction vessel contents. If the moisture was above 0.01%, the contents of the reaction vessel were dried for 1 hour at 110° C. while pulling 30 inches of vacuum. The system was purged with dry nitrogen to break the vacuum and cooled. Sodium borohydride, 12.6 g, was added to the reaction vessel and the reaction mixture was stirred at 50°-60° C. for one hour. The contents were cooled to 40°-60° C. and 3595 g (32.1 moles) of potassium tert-butoxide were added in two equal parts, waiting 15 minutes between each part. Sodium monochloroacetate, 3670 g (31.5 moles), was added to the reaction vessel with stirring at such a rate that the exotherm could be controlled to maintain the temperature at 50°-75° C. Upon completion of the addition, the temperature of the reaction mixture was maintained at 70°-75° C. for 30 minutes, after which time the temperature was raised to 80°-90° C., and the reaction mixture was stirred for 12 hours at this temperature. The contents were then sampled in the following manner to determine acid value and hydroxyl number as a measure of the extent of reaction. A 40.0 g sample was charged to a vessel and heated to 75°-80° C. with stirring. Then 40.0 g of a hot (75° C.) 7.5% aqueous solution of sulfuric acid was added and the mixture was stirred at 75° C. for one minute. The mixture was transferred to a separatory funnel and the layers allowed to separate. The bottom aqueous layer was discarded and the organic layer was washed twice with 20.0 g each of a hot (75° C.) 10% aqueous solution of sodium chloride. The organic layer was then isolated and dried in a rotary evaporator at 90°-100° C. The acid value and hydroxyl number of the resulting oil were measured and found to be 126 mg KOH/g and 10 mg KOH/g respectively. A minimum acid value of 125 mg KOH/g and a maximum hydroxyl number of 16 mg KOH/g are preferred which represent a minimum 90% conversion of the alcohol ethoxylate into the ether carboxylic acid. If the acid value is low and the hydroxyl number is high, the contents of the reaction vessel may be stirred an additional 6 hours at 80°-90° C. and reanalyzed. If the acid value is still low with a high hydroxyl number, it may be necessary to cool the reaction mixture to 40°-50° C. and add additional potassium tert-butoxide equivalent to the remaining unreacted alcohol ethoxylate. Then stir the reaction mixture for 15 additional minutes at 40°-50° C. Next, heat the reaction mixture to 60°-70° C. and add an equivalent amount of sodium monochloroacetate. Stir the reaction mixture at 70°-90° C. for 4 hours and then recheck the acid value and hydroxyl number. When the acid value and hydroxyl number were acceptable, vacuum was slowly pulled on the reaction vessel to 30 inches, being careful to avoid foaming, and the reaction mixture was stirred at 70°-90° C. under 30 inches of vacuum for 30 minutes to remove tert-butyl alcohol produced during the reaction. The vacuum was then broken with nitrogen, and 17800 g of a 7.5% aqueous solution of sulfuric acid which had been heated to 80° C. was added slowly while maintaining the temperature at 70°-80° C. The resulting mixture was stirred for one minute and transferred to a separatory funnel where the layers were allowed to separate. The bottom aqueous layer was discarded, and the organic layer was washed twice with 9000 g of a hot (80° C.) 10% aqueous solution of sodium chloride. The organic layer was then isolated and dried. The resulting oil was filtered to yield a compound of the formula $$C_8H_{17}—O—(C_2H_4O)_5—CH_2COOH$$

(b) Preparation of title compound 10200 g (25 moles) of the compound prepared in (a) above was charged to a flask for esterification having standard apparatus for agitation, heating, distillation, addition and sub-surface methanol addition. 155 g of sodium bisulfate solution (50%) and 4.4g of hypophosphorous acid solution (50%) were added, and the contents were heated to 125° C. under a dry nitrogen sparge to remove any water. When all water was removed, the sub-surface addition of methanol was started, and methanol was added in 1000 ml increments. After each addition of methanol, the acid value of the contents was checked. When a maximum acid value of 1.0 mg KOH/g was reached, indicating approximately 99% conversion to the ester, a vacuum was pulled on the reaction flask to 30 inches and the contents were stirred at 125° C. to remove all traces of unreacted methanol. The contents were then cooled to 70° C. and the vacuum was broken with dry nitrogen. The pH (5% in distilled water) of the contents was adjusted to 6.0–7.5 with sodium hydroxide, and the resulting oil was filtered to yield a compound of the formula $$C_8H_{17}—O—(C_2H_4O)_5—CH_2COOCH_3$$

EXAMPLE II

Preparation of Octadecyl Carbomethoxymethyl PEG 220 Ether

Following essentially the procedure of Example I, and using in place of the 5 mole ethoxylate of octyl alcohol an equivalent amount of the 5 mole ethoxylate of octadecyl alcohol (alkyl chain 95% minimum C18, hydroxyl number 114 mg KOH/g), along with an equal amount of dry toluene as solvent which was removed after the last washing step by distillation, a compound of the formula $$C_{18}H_{37}—O—(C_2H_4O)_5—CH_2COOCH_3$$

was obtained.

EXAMPLE III

Preparation of Hexadecyl/Octadecyl Carbomethoxymethyl PEG 220 Ether

Following essentially the procedure for Example II, and using in place of the 5 mole ethoxylate of octadecyl alcohol an equivalent amount of the 5 mole ethoxylate of hexadecyl/octadecyl alcohol (alkyl chain approximately 35% $C_{16}$ and 65% $C_{18}$, hydroxyl number 116 mg KOH/g), a compound of the formula $$C_{16}H_{33}/C_{18}H_{37}—O—(C_2H_4O)_5—CH_2COOCH_3$$

was obtained.

EXAMPLE IV

Following essentially the procedure of Example I and using the appropriate starting alcohol ethoxylate, the following compounds were obtained:

(a) Octyl/decyl carbomethoxymethyl PEG 220 ether starting with the 5 mole ethoxylate of octyl/decyl alcohol (alkyl chain approximately 45% $C_8$ and 55% $C_{10}$, hydroxyl number 153 mg KOH/g).

(b) Octyl/decyl carbomethoxymethyl PEG 352 ether starting with the 8 mole ethoxylate of octyl/decyl alcohol (alkyl chain approximately 45% $C_8$ and 55% $C_{10}$, hydroxyl number 113 mg KOH/g). 20 (c) Octyl carbomethoxymethyl PEG 528 ether starting with the 12 mole ethoxylate of octyl alcohol (alkyl chain 95% minimum $C_8$, hydroxyl number 85 mg KOH/g).

(d) Nonyl/decyl/undecyl carbomethoxymethyl PEG 352 ether starting with the 8 mole ethoxylate of nonyl/decyl/undecyl alcohol (alkyl chain approximately 30% $C_9$, 40% $C_{10}$ and 30% $C_{11}$, hydroxyl number 110 mg KOH/g)

(e) Dodecyl/tetradecyl carbomethoxymethyl PEG 220 ether starting with the 5 mole ethoxylate of dodecyl/tetradecyl alcohol (alkyl chain approximately 70% $C_{12}$ and 30% $C_{14}$, hydroxyl number 135 mg KOH/g )

(f) Tridecyl carbomethoxymethyl PEG 374 ether starting With the 8½ mole ethoxylate of n-tridecyl alcohol (alkyl chain 95% minimum $C_{13}$, hydroxyl number 98 mg KOH/g).

(g) Iso-octadecyl carbomethoxymethyl PEG 220 ether starting with the 5 mole ethoxylate of iso-octadecyl alcohol (alkyl chain approximately 75% iso-$C_{18}$, hydroxyl number 109 mg KOH/g)

(h) Octadecyl carbomethoxymethyl PEG 528 ether starting With the 12 mole ethoxylate of octadecyl alcohol (alkyl chain 95% minimum $C_{18}$, hydroxyl number 70 mg KOH/g).

(i) Octadecyl carbomethoxymethyl PPG 58-PEG 220 ether starting with octadecyl alcohol which had been reacted with 1 mole of propylene oxide followed by 5 moles of ethylene oxide (alkyl chain 95% minimum $C_{18}$, hydroxyl number 101 mg KOH/g).

EXAMPLE V

Methyl Carbo (Nonoxy/Decoxy/Undecoxy)Methyl PEG 352 Ether (a) Following essentially the procedure of Example I(a) and using in place of the 5 mole ethoxylate of octyl alcohol an equivalent amount of the 8 mole ethoxylate of methyl alcohol (alkyl chain 99% minimum $C_1$, hydroxyl number 146 mg KOH/g), a compound of the formula $$CH_3—O—(C_2H_4O)_8—CH_2CO_2H—$$

was obtained.

(b) 884 g (2.0 moles) of the compound prepared in (a) above was charged to a flask for esterification having standard apparatus for agitation, heating, distillation and addition. 320 g (2.0 moles) of nonyl/decyl/undecyl alcohol and 0.6 g of hypophosphorous acid (50% in water) were added, and the mixture was heated to 170° C. After 36 mls of water were collected, the reaction mixture was cooled to give the title compound.

An effective amount of the compounds corresponding to Examples I, II, III, IVa, IVb, IVc, IVd, IVe, IVf, IVg, IVh, IVi, and V as described in the Description of Specific Embodiments were used in the methods to coat fibers without the use of emulsifiers, or other components and were tested for properties desirable to fiber lubricants. Certain of the above compounds were preferably used to coat a specific fiber. The following test results were obtained.

EXAMPLE VI

Test Results

A comparison was made of fiber-to-metal and fiber-to-fiber coefficients of friction in the methods of which various existing lubricant compounds, i.e. compounds A and B of tables 1, 2 and 3, with the present method in which compounds described hereinabove were applied to three commercially important fibers. Compound A was Emerest 2654 PEG 400 Monopelargonate and Compound B was Emery 6724 Methoxy PEG 400 Pelargonate. Both of these compounds are available commercially from Henkel Corporation and are widely used as lubricants in fiber finishes. Kinematic viscosity was measured in centistokes at 40° C. using Ubbelohde Viscometer tubes. Coefficients of friction ($\mu$) were measured using a Rothschild F meter with fiber speeds of 100 meters per minute and 1 centimeter per minute. The first value listed for the coefficient of fiber-to metal friction was determined using a polished chrome pin, while the second value was determined using a 55RMS matte stainless steel pin. The values listed in Table 1 were determined on 200 denier nylon which had been stripped of all finish before the lubricant to be studied was applied. The lubricant to be studied was applied at 0.5 weight percent on weight of fiber. The values listed in Table 2 were determined on 150 denier polyethyleneterephthalate which had been made without finish, and the lubricant to be studied was applied at 0.5 weight percent on weight of fiber. The values in Table 3 were determined on 260 denier polypropylene which had been made without finish, and the lubricant to be studied was applied at 1.0 weight percent on weight of fiber.

As can be readily seen from the data in Tables 1, 2 and 3 practicing the methods of this invention we have achieved comparable or higher viscosity and produced comparable or lower coefficients of fiber-to-metal or fiber-to-fiber friction for certain commercially important fibers as when compared to the commercially available products. This data indicates that the present methods impart desirable lubricity onto commercially important fibers.

TABLE 1

| PRODUCT | VISCOSITY 40° C., CST | 100 m./min. $\mu$F/M | 100 m./min. $\mu$F/F | 1 cm./min. $\mu$F/F | 1 cm./min. S-S (g) |
|---|---|---|---|---|---|
| A | 36 | 0.60<br>0.27 | 0.12 | 0.033 | 37 |
| B | 20 | 0.50<br>0.26 | 0.12 | 0.033 | 52 |
| Example IVb | 34 | 0.56<br>0.25 | 0.11 | 0.045 | 30 |
| Example IVd | 28 | 0.54<br>0.25 | 0 11 | 0.050 | 40 |
| Example V | 26 | 0.48<br>0.26 | 0.11 | 0.045 | 45 |
| Example IVc | 45 | 0.55<br>0.29 | 0.10 | 0.040 | 28 |
| Example IVf | 38 | 0.54<br>0.25 | 0.10 | 0.035 | 23 |
| Example III | 460 | 0.55<br>0.24 | 0.12 | 0.028 | 9 |
| Example II | 121 | 0.40<br>0.23 | 0.10 | 0.034 | 12 |
| Example IVg | 36 | 0.52<br>0.25 | 0.11 | 0.033 | 23 |
| Example IVh | 79 | 0.62<br>0.27 | 0.11 | 0.030 | 15 |

TABLE 2

| PRODUCT | VISCOSITY 40° C., CST | 100 m./min. $\mu$F/M | 100 m./min. $\mu$F/F | 1 cm./min. $\mu$F/F | 1 cm./min. S-S (g) |
|---|---|---|---|---|---|
| A | 36 | 0.65<br>0.28 | 0.13 | 0.033 | 13 |
| B | 20 | 0.56<br>0.28 | 0.13 | 0.033 | 18 |
| Example IVa | 21 | 0.62<br>0.26 | 0.12 | 0.033 | 13 |
| Example IVe | 25 | 0.57<br>0.24 | 0.12 | 0.030 | 13 |
| Example IVi | — | 0.65<br>0.29 | 0.14 | 0.025 | 7 |

TABLE 3

| PRODUCT | VISCOSITY 40° C., CST | 100 m./min. $\mu$F/M | 100 m./min. $\mu$F/F | 1 cm./min. $\mu$F/F | 1 cm./min. S-S (g) |
|---|---|---|---|---|---|
| A | 36 | 0.59<br>0.31 | 0.14 | 0.046 | 28 |
| B | 20 | 0.51<br>0.25 | 0.11 | 0.046 | 29 |
| Example I | 28 | 0.56<br>0.25 | 0.12 | 0.050 | 23 |
| Example IVa | 21 | 0.54<br>0.30 | 0.12 | 0.046 | 20 |

What is claimed is:

1. A method for imparting lubricity in a fiber which comprises applying to said fiber of a compound having the general formula $$R_1-O-(X)_n-CH_2-\overset{\overset{\displaystyle O}{\|}}{C}-O-R_2 \qquad (I)$$

wherein $R_1$ is an alkyl group from 1 to 23 carbon atoms, $R_2$ is an alkyl group from 1 to 23 carbon atoms, n is a number from 3 to 15, and X is $-C_2H_4O-$ or $-C_3H_6O-$, or a mixture of $-C_2H_4O-$ and $-C_3H_6O-$, and said compound is an amount effective to provide lubrication.

2. The method of claim 1 wherein $R_1$ is an alkyl group from 6 to 20 carbon atoms.

3. The method of claim 2 wherein $R_1$is an alkyl group from 16 to 18 carbon atoms.

4. The method of claim 2 wherein $R_1$ is alkyl group from 12 to 14 carbon atoms.

5. The method of claim 4 wherein $R_1$ is an alkyl group from 8 to 10 carbon atoms.

6. The method of claim 1 wherein $R_2$ is methyl.

7. The method of claim 1 wherein n is 3 to 5.

8. The method of claim 1 wherein n is 5.

9. The method of claim 1 wherein X is $-C_2H_4O-$.

10. A method for imparting lubricity to a fiber which comprises applying to said fiber a compound having the general formula $$R_1-O-(X)_n-CH_2-\overset{\overset{\displaystyle O}{\|}}{C}-O-R_2 \qquad (I)$$

wherein $R_1$ is an alkyl group from 6 to 20 carbon atoms, $R_2$ is an alkyl group from 1 to 3 carbon atoms, n is a number from 3 to 15, and X is $-C_2H_4O-$, and said compound is in an amount effective to provide lubrication.

11. A method for imparting lubricity to a fiber which comprises applying to said fiber a compound having the general formula $$R_1-O-(X)_n-CH_2-\overset{\overset{\displaystyle O}{\|}}{C}-O-R_2 \qquad (I)$$

wherein $R_1$ is an alkyl group from 16 to 18 carbon atoms, $R_2$ is a methyl group, n is 5 and X is $-C_2H_4O-$, and said compound is in an amount effective to provide lubrication.

12. A method for imparting lubricity to a fiber which comprises applying to said fiber a compound having the general formula $$R_1-O-(X)_n-CH_2-\overset{\overset{\displaystyle O}{\|}}{C}-O-R_2 \quad (I)$$

wherein $R_1$ is an alkyl group from 8 to 10 carbon atoms, $R_2$ is a methyl group, n is 5 and X is $-C_2H_4O-$, and said compound is in an amount effective to provide lubrication.

13. A method for imparting lubricity to a fiber which comprises applying to said fiber a compound having the general formula $$R_1-O-(X)_n-CH_2-\overset{\overset{\displaystyle O}{\|}}{C}-O-R_2 \quad (I)$$

wherein $R_1$ is an alkyl group having 18 carbon atoms, $R_2$ is a methyl group, n is 5 and X is $-C_2H_4O-$, and said compound is in an amount effective to provide lubrication.

* * * * *